US005121900A

United States Patent [19]

McDonald

[11] Patent Number: 5,121,900

[45] Date of Patent: Jun. 16, 1992

[54] TRANSPORTABLE FLUID JACK

[76] Inventor: James W. McDonald, R.R. #1, Box 741, New Baden, Ill. 62265

[21] Appl. No.: 652,780

[22] Filed: Feb. 8, 1991

[51] Int. Cl.[5] ..... B66F 3/24

[52] U.S. Cl. ..... 254/2 R

[58] Field of Search ..... 254/93 R, 93 HP, 93 H, 254/2 R; 92/34, 35, 42

[56] References Cited

U.S. PATENT DOCUMENTS

| | | | |
|---|---|---|---|
| 2,001,744 | 5/1935 | Patterson . | |
| 2,495,092 | 1/1950 | Cox et al. . | |
| 2,610,824 | 9/1952 | Grier | 254/93 HP |
| 3,174,722 | 3/1965 | Alm . | |
| 3,326,311 | 6/1967 | Jung . | |
| 3,612,484 | 10/1971 | Gallagher et al. | 254/93 HP |
| 3,664,636 | 5/1972 | Sherrill . | |
| 3,695,582 | 10/1972 | Clay | 254/93 HP |
| 3,994,474 | 11/1976 | Finkbeiner . | |
| 4,102,373 | 7/1978 | Winiasz | 254/93 HP |
| 4,323,141 | 4/1982 | Ragan et al. . | |
| 4,560,145 | 12/1985 | Widmer . | |
| 4,605,203 | 8/1986 | Hooper et al. . | |

FOREIGN PATENT DOCUMENTS

| | | | |
|---|---|---|---|
| 901255 | 6/1980 | U.S.S.R. | 254/2 R |

*Primary Examiner*—Robert C. Watson

*Attorney, Agent, or Firm*—Rogers, Howell & Haferkamp

[57] ABSTRACT

A transportable fluid pressure operated lifting jack comprises a load platform and a base platform with a bellows type fluid pressure expandable air bag secured between the platforms. A self-contained source of fluid pressure is supported on the jack and is selectively communicated with the air bag to raise the load platform and an object it supports, or is selectively exhausted to lower the load platform and the object is supports. Vertical guide bars extend between the load and base platforms and guide the upward, vertical movement of the load platform relative to the base platform.

15 Claims, 2 Drawing Sheets 12
14
16
174
78
166
124
122
132
154
114
144
152
96
136
118
138
156
126
134
76
116
128
74
108
104
64
106
68
58
56
66
4
49
36
22
26
34
38
50
46
47
45
24
28
44
42
18
54
92
88
102
98
84
82

TRANSPORTABLE FLUID JACK

BACKGROUND OF THE INVENTION (1.) Field of the Invention

The present invention relates to a transportable fluid jack, in particular a transportable fluid jack apparatus comprising a load platform that is selectively raised and lowered by a bellows type expandable bag. The bag is selectively supplied with pressurized fluid from a self-contained source of pressurized fluid supported on the jack to raise the load platform, and is selectively exhausted of pressurized fluid filling the bellows bag to lower the load platform.

(2) Description of the Related Art

Various types of lifting devices are known in the prior art and many of these known devices are portable. Some of the portable lifting devices employ inflatable air bags that extend vertically when inflated and impart a lifting force to an object to be raised by the device. The inflatable bags are then exhausted and deflated, causing the bag to collapse vertically and lower the object lifted by the air bag.

A disadvantage often encountered in these types of lifting devices is that the inflatable air bags employed to exert the lifting force are not of themselves laterally stable. Lifting devices employing inflatable air bags often require additional support structure surrounding the lifting bag to resist any excessive side to side lateral movement of an object being raised. For example, if the load raised by the lifting bag is distributed unevenly on the bag it could cause the bag to collapse over on one side. Additional support structure is needed to prevent this occurrence. The additional lateral supporting structure of the prior art devices often makes the jack device cumbersome, and the vertical dimensioning of the support structure often limit the environments in which the device may be used. The lateral support structures are constructed to collapse or fold downward as the inflatable air bag is deflated. However, some support structures, even when collapsed, require a certain vertical clearance before the collapsed lifting device can be inserted beneath an object to be lifted.

Another disadvantage often encountered in the use of lifting jacks of the type employing an inflatable air bag is that they require a separate source of pressurized fluid to fill the bag and raise the lifting device. This limits the applications in which the inflatable bag type of lifting device may be used. Prior art inflatable bag lifting devices often may only be used in areas where there is access to a separate source of compressed fluid to fill the lifting inflatable bag, or there is access to a separate power source to operate a pump supplying pressurized fluid to the inflatable bag.

It is an object of the present invention to overcome these shortcomings of prior art inflatable bag lifting devices by providing a transportable fluid jack apparatus that includes a vertical support structure for a lifting inflatable bag that does not interfere with the insertion of the lifting bag beneath an object to be lifted, and also includes its own self-contained source of pressurized fluid and does not rely on external sources of pressurized fluid or power to operate the inflatable bag of the apparatus.

SUMMARY OF THE INVENTION

The transportable fluid pressure operated lifting jack of the present invention is generally comprised of a fluid lifting assembly and a fluid control assembly.

The fluid lifting assembly includes a horizontal base platform and a load platform positioned above and parallel with the base platform. A bellows type expandable bag such as an air bag is positioned between the two platforms and is secured to the top of the base platform and the underside of the load platform. The bellows type air bag is selectively inflated and deflated to raise and lower the load platform relative to the base platform along with an object supported on the load platform.

A guide rail assembly is rigidly secured to a rearward end of the base platform. The guide rail assembly includes a pair of vertical bars that are positioned perpendicular to the base platform and extend upward from the base platform. The load platform is connected by a universal connection to a sleeve that is mounted for axial sliding movement on a transverse rod. The rod is connected between a pair of brackets that slidingly engage over the bars of the guide rail assembly. The pair of brackets permit the transverse rod and connected load platform to move vertically upward and downward relative to the bars of the guide rail assembly and the base platform, while preventing excessive movement of the load platform laterally relative to the bars of the guide rail assembly and the base platform. The universal connection between the load platform and the sleeve, and the sliding connection of the sleeve on the transverse rod enable the load platform to pivot freely above the base platform.

The fluid lifting assembly is pivotally connected to a jack frame that supports a housing containing the fluid control assembly of the invention. The frame is supported by a pair of wheels positioned at the pivot connection between the frame and the lifting assembly. The frame is provided with a manually operated lock mechanism that locks the frame in two positions relative to a lifting assembly: a horizontal position where the frame is substantially parallel with the lifting assembly, and a vertical position where the frame is substantially perpendicular to the lifting assembly.

The fluid control assembly contained in the housing on the jack frame includes a gas storage tank, a system of fluid conduits, and a pair of manual control valves. The storage tank contains a gas, such as nitrogen, under pressure. The fluid conduits communicate the storage tank with the air bag, and communicate the air bag with an exhaust valve. The manually operated control valves control the supply of pressurized gas to the bellows air bag and the exhausting of pressurized gas from the air bag. Pressure gauges and safety valves are also provided in the fluid conduit system to provide a visual indication of the fluid pressure in the storage tank and in the bellows type air bag, and a means of safely exhausting pressurized fluid from the conduit system to prevent rupturing of the storage tank or the air bag in the event of fire or over inflation.

The transportable fluid pressure operated lifting jack of the present invention is capable of being transported to virtually any location, indoors or out. The jack is transported by first tilting the apparatus slightly rearward with the frame locked perpendicular to the lifting assembly. This lifts the lifting assembly up from the ground and supports the jack on its wheels. The apparatus is then manually wheeled to the location of the object desired to be lifted. The locking mechanism between the jack frame and the lifting assembly is then manually unlocked to permit the jack frame to be lowered and positioned substantially parallel with the lifting assembly. The lifting assembly is then inserted beneath the object to be lifted. The user may then operate the locking mechanism to permit the jack frame to be elevated again to its perpendicular position relative to the lifting assembly and relock the frame in this position. The user then selectively operates one of the two manual control levers to drain pressurized gas from the storage tank and supply the pressurized gas to the bellows air bag of the lifting assembly. Supplying pressurized gas to the bellows air bag causes the air bag to expand vertically and lift the load platform and the object it supports relative to the base platform. The guide rails ensure that the load platform raises substantially straight above the base platform and prevents any excessive laterally side to side movement of the load platform relative to the base platform other than that permitted by the sliding connection of the load platform sleeve on the transverse bar. The sliding connection of the load platform sleeve on the transverse bar permits some limited transverse movement of the load platform if so desired This ensures that there are no lateral stresses exerted on the bellows air bag as it expands. When it is desired to lower the object, the user manipulates the second control lever to cause the pressurized gas filling the bellows air bag to exhaust from the bag, and cause the bag to collapse vertically. The vertically collapsing air bag lowers the load platform and the object supported thereon. With the air bag completely exhausted and collapsed, the fluid operated jack of the invention may then be wheeled out from under the object, thereby completing the lifting operation.

DETAILED DESCRIPTION OF THE PREFERRED EMBODIMENT

Figure 1:
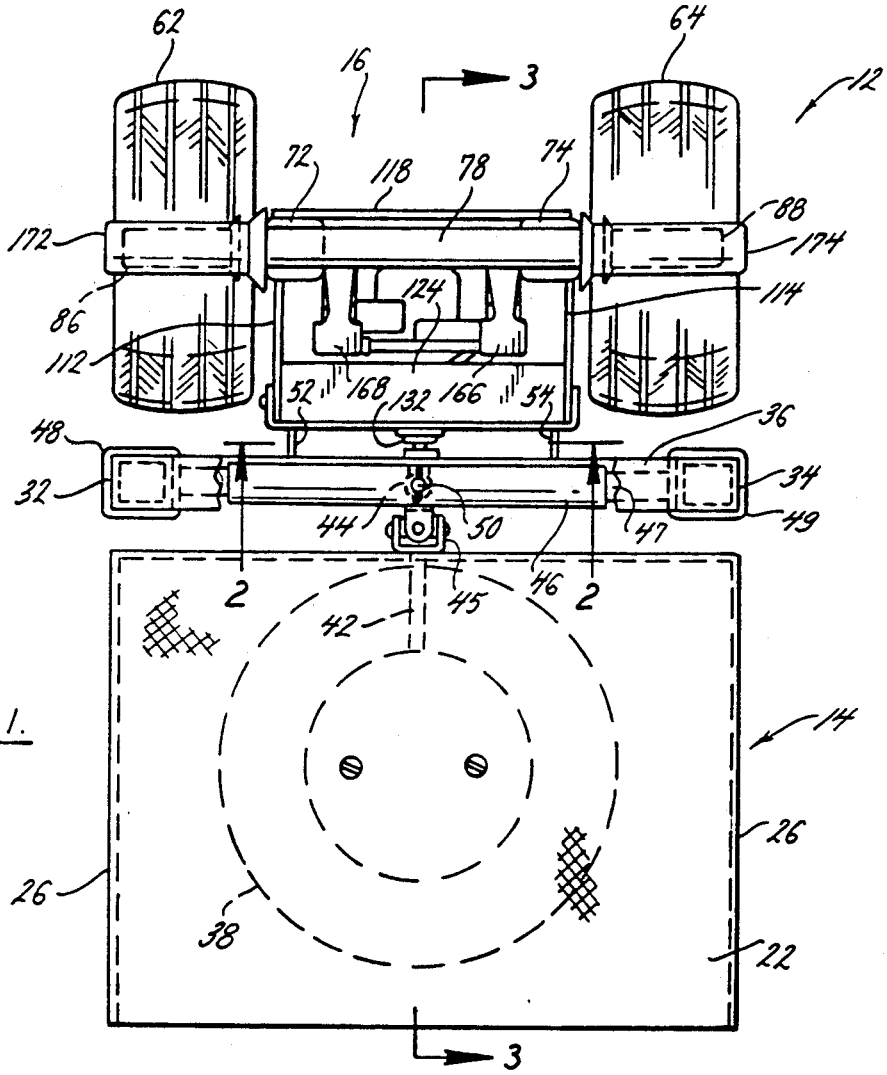
FIG. 1 is a plan view of the fluid pressure operated lifting jack of the present invention.
Figure 2:
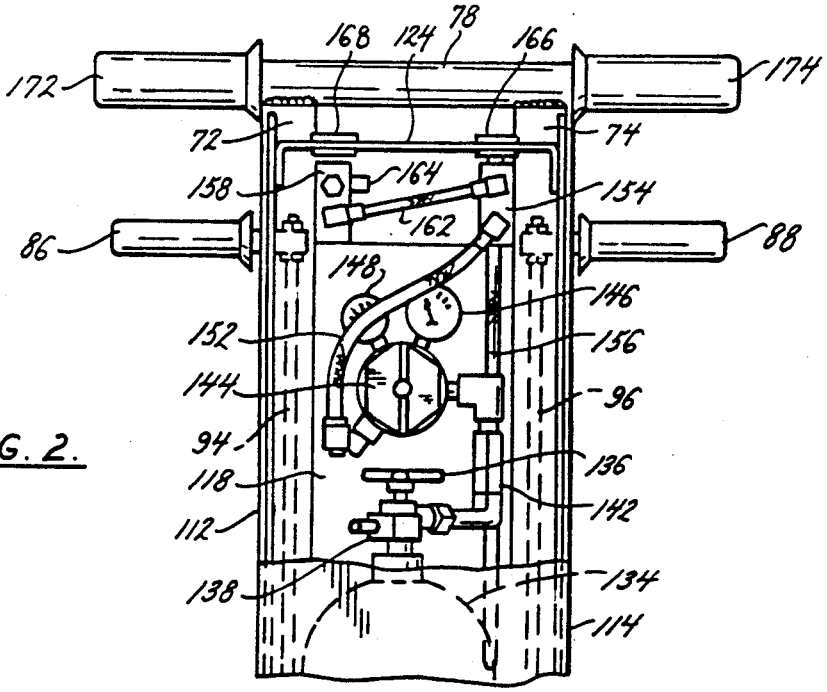
FIG. 2 is a segmented front elevation view, partially in section, showing components of the fluid control assembly of the lifting jack taken along the line 2—2 of FIG. 1.

The transportable fluid pressure operated lifting jack 12 of the present invention is generally comprised of a fluid lifting assembly 14 and a fluid control assembly 16. These two assemblies are best seen in FIGS. 1 and 3.

The fluid lifting assembly 14 includes a base platform 18 and a load platform 22 positioned above and parallel to the base platform. The base platform and load platform are constructed from square metal plates having bent over side edges 24, 26, respectively, reinforcing the plates against bending. The side edges 26 of the load platform 22 depend downward, and the side edges 24 of the base platform project upward as is best seen in FIG. 3. A reinforcing angled member 28 connects the lateral side edges 24 of the base plate at a rearward side of the base plate. Secured at opposite ends of the angled member 28 and projecting vertically upward and perpendicular to the base plate 18 are a pair of vertical bars 32, 34. The vertical bars are secured at their top ends to a horizontal reinforcing bar 36.

Figures 3, 4:
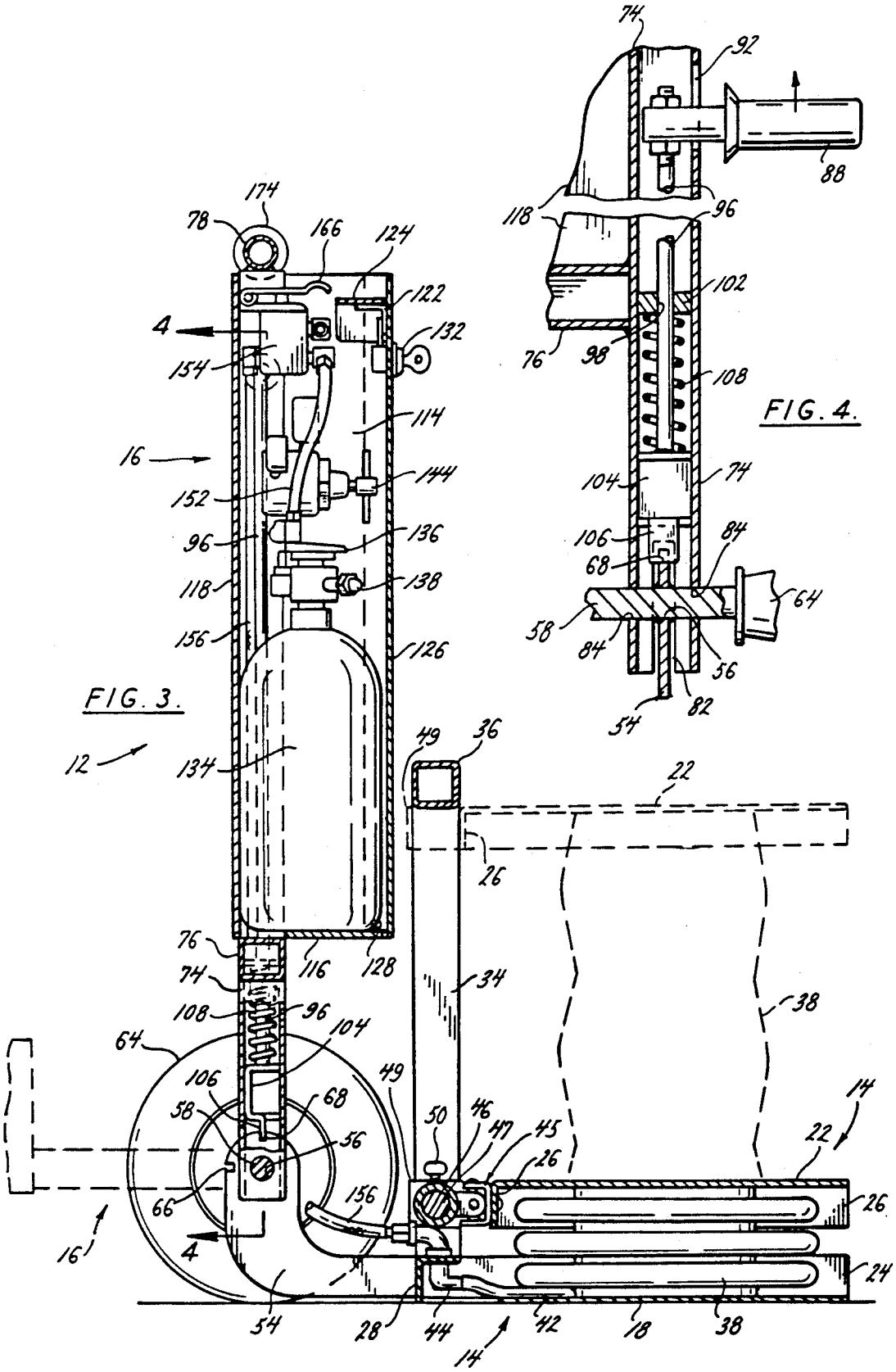
FIG. 3 is a side elevation view in section of the lifting jack taken along the line 3—3 of FIG. 1.
FIG. 4 is a segmented elevation view in section of the manually operated locking mechanism of the lifting jack taken along the line 4—4 of FIG. 3.

A bellows type fluid expandable bag such as an air bag 38 is secured to a top surface of the load platform 18 as viewed in FIG. 3. A fluid conduit 42 communicates with the interior of the air bag 38 and is connected to a coupling 44 supported on the angled member 28 of the base platform 18. An upper end of the air bag 38 is secured to an underside of the load platform 22 as viewed in FIG. 3, thereby securing the air bag between the load and base platforms.

The load platform 22 is connected by a universal coupling 45 to a tubular sleeve 46. The tubular sleeve 46 is slidably mounted on a transverse rod 47 having a pair of sliding brackets 48, 49 secured at its opposite ends. The pair of sliding brackets 48, 49 engage around the pair of vertical bars 32, 34, respectively, and provide a sliding connection between the load platform 22 and the vertical bars 32, 34. The pair of vertical bars 32, 34 serve as a means of guiding the upward and downward vertical movement of the load platform 22 relative to the base platform 18 while preventing excessive lateral movement between the load platform and the base platform. The universal coupling 45 connecting the load platform 22 to the tubular sleeve 46 enables the load platform to pivot freely relative to the tubular sleeve. The sliding connection of the tubular sleeve 46 over the transverse rod 47 permits the sleeve and connected load platform to rotate about the axis of the transverse rod 47 and to move laterally a limited distance over the rod. The lateral movement of the tubular sleeve 46 and the connected load platform 22 is limited by the ends of the sleeve contacting the sliding brackets 48, 49 secured at the opposite ends of the rod. A threaded hole (not shown) is provided at the center of the tubular sleeve 46 and a threaded key 50 is screw threaded into the hole. By turning the key 50 so that its end engages against the transverse rod 47, the tubular sleeve 46 can be secured in a set position relative to the transverse rod 47. In this manner the key 50 can be employed to set the position of the sleeve 46 relative to the rod 47 and prevent the sleeve from rotating over the rod or from sliding laterally relative to the rod. The universal coupling 45 between the load platform 22 and the sleeve 46, and the sliding connection of the sleeve 46 on the transverse rod 47 enable the load platform 22 to pivot freely above the base platform 24 and also permit limited lateral movement of the load platform 22 above the base platform 24.

A pair of axle forks 52, 54 are secured to and project rearward from the angled member 28 of the base platform and curve in a general upward direction as seen in FIG. 3. A pair of concentric holes 56 are provided through the upward extensions of the axle forks 52, 54 and a wheel axle 58 extends through the pair of holes. A pair of wheels 62, 64 are secured on the opposite ends of the axle 58 outside the axle forks 52, 54. The upward extensions of the axle forks 52, 54 are also provided with a pair of slots 66, 68 cut into the edge of the fork extensions. The slots are employed with the lifting jack locking mechanism to be described.

The fluid control assembly 16 is generally comprised of a frame pivotally connected with the fluid lifting assembly 14 and a control housing supported on the frame. The frame is comprised of a pair of spaced, parallel side bars 72, 74 that are connected together in rectangular configuration with a lower transverse bar 76 and an upper handlebar 78. The side bars are preferably square, hollow channel members. A slot 82 is cut through the front and back surfaces of each side bar 72, 74 at the lower most ends of the side bars as viewed in FIG. 3. Concentric holes 84 are also provided through the lower ends of the side bars 72, 74. The axis of the concentric holes 84 is perpendicular to the plane of the slots 82 cut in the lower ends of the side bars 72, 74. The upward extending portions of the axle forks 52, 54 extend into the slots 82 provided in the lower ends of the frame side bars 72, 74 so that the concentric holes 84 provided through the bottoms of the side bars 72, 74 are lined up coaxially with the holes 56 provided in the upward extending portions of the axle forks 52, 54. The axle 58 extends through the concentric holes of the side bars 72, 74 and the axle forks 52, 54 to pivotally connect the frame of the fluid control assembly 16 to the fluid lifting assembly.

Manually operated locking mechanisms are provided in each of the side bars 72, 74 of the frame. The locking mechanisms enable the frame to be locked in first and second positions relative to the fluid lifting assembly 14. In the first position, the fluid control assembly 16 is substantially perpendicular to the fluid lifting assembly 14, and in the second position the fluid control assembly 16 is substantially parallel with the fluid lifting assembly 14 as depicted by the phantom lines in FIG. 3. The locking mechanisms are comprised of a pair of hand grips 86, 88 that extend through slots 92 provided in the side bars 72, 74 of the frame. The hand grips 86, 88 are connected to reciprocating rods 94, 96 that extend downward through the interiors of the side bars 72, 74 respectively. The locking mechanisms in each of the side bars are substantially identical and only one locking mechanism will be further described. Each reciprocating rod is slidably received in a hole 98 through a reaction plate 102 secured in the interior of a side bar. An engagement plug 104 is provided at the bottom end of the reciprocating rod 96. The engagement plug is slidably received in the interior of the side bar and is provided with a projecting tab 106 at its bottom end. The projecting tab 106 is dimensioned to be selectively engaged in one of the pair of slots 66, 68 provided in the periphery of the upper extension of the axle fork 54. A coiled spring 108 surrounds the reciprocating rod 96 between the reaction plate 102 and the engagement plug 104 and biases the plug and tab 106 in a downward direction.

As seen in FIG. 3, the engagement of the plug tab 106 in the upper slot 68 of the axle fork 54 locks the fluid control assembly 16 in a generally perpendicular position relative to the fluid lifting assembly 14. To move the fluid control assembly 16 to its second, generally horizontal position relative to the fluid lifting assembly 14, the user first pulls upward on the hand grips 86, 88 causing the engagement plugs 104 and tabs 106 to slide upward in the interior of the side bars 72, 74 against the bias of the springs 108. The upward movement of the plugs and tabs 106 disengages the tabs from the upper slots 68 in the axle forks 52, 54. The user may then pivot the fluid control assembly 16 rearward about the axle 58 to its second position shown in phantom lines in FIG. 3. Once the fluid control assembly 16 is initially moved from its perpendicular orientation relative to the fluid lifting assembly 14, the user may then release the hand grips 86, 88. This causes the engagement plugs 104 and tabs 106 to be spring biased into engagement with the periphery of the upper extensions of the axle forks 52, 54. The tabs 106 will slide along the upper periphery of the axle forks until the fluid control assembly 16 is positioned substantially parallel with the fluid lifting assembly 14 and the tabs 104 engage in the lower slots 66 in the periphery of the axle fork extensions 52, 54. The engagement of the tabs 106 in the lower slots 66 locks the fluid control assembly 16 in its second position substantially parallel with the fluid lifting assembly 14. Should it be desired to reposition the fluid control assembly 16 in its upright position perpendicular to the lifting assembly 14, the user need only reverse the aforementioned steps.

The frame of the fluid control assembly 16 also supports a housing for the pressurized fluid supply and the operative controls of the fluid pressure operated lifting jack. The housing includes a pair of opposed side walls 112, 114 connected by a bottom wall 116 and a back wall 118 of the housing. The side walls 112, 114 and the back wall 118 are secured to the frame side bars 72, 74, thereby securing the housing to the frame. A reinforcing angled bar 122 is secured between the side wall 112, 114 at an upper, forward portion of the side walls. A top plate 124 is secured over the angled reinforcing member 122. A hinged door 126 covers a front opening of the housing. The door 126 is pivotally attached over the front opening of the housing by a pivot pin 128 that extends through both side walls 112, 114 of the housing at a lower, forward corner of the side walls. A key lock 132 is provided in an upper centered position on the door 126. The key lock 132 locks the door 126 in its closed position shown in the drawing figures, and when unlocked permits the door 126 to pivot forward about the pivot pin 128 and expose the interior of the fluid control assembly housing.

The interior of the housing contains a pressurized fluid storage tank 134. The storage tank 134 stores the fluid under pressure used to selectively inflate and raise the air bag 38. Pressurized nitrogen is preferably used as the fluid stored in the tank to avoid corrosion of valves and fittings in the fluid communication system to be described However, other pressurized gases may be used in lieu of nitrogen. The pressurized fluid storage tank 134 is provided with a manually operated valve 136 to open and close communication with the tank, and a pressure release safety valve 138 that relieves the pressure of the tank should it exceed a predetermined level. The structure of the manual valve 136 and the pressure release valve 138 are conventional for pressurized fluid storage tanks. The storage tank 134 communicates through a length of conduit 142 with a pressure regulator 144. The pressure regulator 144 is conventional and controls the level of fluid pressure communicated from the storage tank 134 to the air bag 38. The pressure regulator 144 is provided with a pair of pressure gauges 146, 148, the first of which provides a visual indication of the pressure of the fluid stored in the storage tank 134, and the second of which provides a visual indication of the pressure of fluid supplied to the air bag 38. A fluid conduit 152 communicates a fluid pressure outlet of the regulator 144 with a first manual valve 154. A needle valve (not shown) is provided in the conduit 152 to regulate the rate at which pressurized fluid is supplied to the manual valve 154. The first manual valve 154 also communicates with the air bag 38 through a fluid conduit 156 that communicates the valve with the coupling 44 mounted on the base plate 18. A second manual valve 158 communicates with the first manual valve 154 through a fluid conduit 162. The second manual valve 158 selectively opens and closes communication between the fluid conduit 162 and an exhaust port 164 of the valve. The first and second manual valves 154, 158 are selectively operated by depressing spring biased lever actuators 166, 168 respectively, provided on the valves.

In operation, a user first transports the fluid pressure operated lifting jack 12 to a desired location by positioning and locking the fluid control assembly 16 perpendicular to the fluid lifting assembly 14, and pulling back on the handlebar handles 172, 174. This causes the jack to pivot around the axle 58 and lift the fluid lifting assembly 14 from the ground, supporting the jack on the wheels 62 64. The lifting jack may then be wheeled to its desired location and the lifting assembly 14 inserted beneath the object to be raised. If the upright fluid control assembly 16 interferes with the insertion of the lifting assembly 14 beneath the object to be raised, the user may release the locking mechanism by pulling upward on the hand grips 86, 88, causing the plug tabs 106 to disengage from the upper slots 68 in the axle forks 52, 54. The fluid control assembly 16 may then be positioned in its second position substantially parallel with the fluid lifting assembly 14.

With the lifting assembly 14 positioned beneath the object to be raised, the user next depresses the RAISE lever 166 of the first manual control valve 154. Depressing the lever 166 communicates the fluid conduit 152 with the fluid conduit 156 and supplies pressurized fluid from the storage tank 134 through the conduit 142, the pressure regulator 144, the conduit 152, the manual valve 154, the conduit 156, the fluid coupling 144, the conduit 142, to the air bag 38. Supplying the pressurized fluid to the air bag in this manner causes the bag to expand vertically upward, raising the load platform 22 and the object it supports upward relative to the base platform 18. As the load platform 22 is raised, the brackets 46, 48 of the load platform slide upward along the vertical bars 32, 34, thereby maintaining the position of the load platform above the base platform even in situations where the load platform is loaded unevenly. When the load platform 22 and the object it supports are raised to their desired height, the user releases the RAISE lever 166 of the first manual control valve 154. This interrupts communication between the fluid conduit 152 leading to the first manual valve 154 and the fluid conduit 156 exiting the valve, and stops the supply of pressurized fluid to the air bag 38.

Releasing the RAISE lever 166 of the first manual control valve 154 also establishes fluid communication between the fluid conduit 156 communicating with the air bag 38 and the fluid conduit 162 communicating with the second manual valve 158. To communicate the fluid conduit 162 with the exhaust outlet 164 of the second manual valve 158, the user depresses the LOWER lever 168 of the second valve. Depressing the LOWER lever 168 establishes communication between the fluid conduit 162 and the exhausts outlet 164 of the second manual control valve 158 and exhausts fluid pressure supplied to the air bag 38 through the conduit 42, the coupling 44, the conduit 156, the first manual valve 154, the conduit 162, the second manual valve 158, and the exhaust outlet 164. Exhausting the pressurized fluid from the air bag 38 in this manner causes the air bag to vertically collapse and lower the load platform 22 and the object it supports relative to the base platform 18. When the air bag 38 is completely collapsed and the load platform 22 is lowered to its at rest position shown in FIG. 3, the user then releases the LOWER lever 168 and removes the lifting assembly 14 from beneath the object by wheeling the jack away from the object.

Each of the fluid conduits employed in the fluid communication circuit of the lifting jack are provided with flow regulating needle valves (not shown) that regulate or limit the rate of fluid flow through the conduits. The conduits themselves are also provided with internal diameters chosen to limit the rate of fluid flow through the conduits. Should one of the conduits break, the pressurized fluid supplied to the air bag 38 will be exhausted at a rate determined by the needle valves and the internal diameters of the conduits that permits the bag to collapse slowly, thereby avoiding injury to anyone standing near the object supported by the lifting jack or damage to the object itself. As an added safety precaution, the fluid conduits themselves are constructed so that if the fluid pressure in the air bag is raised to a dangerous level either by over inflation or by the weight of the load supported by the air bag, the conduit supplying pressurized fluid to the air bag will rupture before the air bag ruptures, thereby causing the air bag to drain through the ruptured conduit at a rate controlled by the internal diameter of the conduit or the needle valve provided in the conduit.

While the present invention has been described by reference to a specific embodiment, it should be understood that modifications and variations of the invention may be constructed without departing from the scope of the invention defined in the following claims.

What is claimed is:

1. A transportable jack apparatus adapted to be transported to and positioned beneath an object to selectively raise and lower the object, the apparatus comprising:

a transportable frame;

a base platform connected to the frame;

a load platform positioned above the base platform;

a self-contained source of pressurized fluid supported on the frame; and an expandable bellows means secured between the base platform and the load platform, the bellows means being adapted to be selectively supplied with fluid from the fluid source, filling the bellows means and causing the bellows means to expand vertically and raise the load platform relative to the base platform and frame, and the bellows means being adapted to be selectively exhausted of fluid filling the bellows means, causing the bellows means to collapse vertically and lower the load platform relative to the base platform and frame.

2. The apparatus of claim 1, wherein:

the self-contained source of pressurized fluid is a tank of pressurized fluid supported on the frame.

3. The apparatus of claim 2, wherein:

the pressurized fluid is nitrogen gas.

4. The apparatus of claim 1, wherein:

a fluid control means communicates the source of pressurized fluid with the bellows means, the fluid control means selectively drains pressurized fluid from the source of pressurized fluid and supplies the drained pressurized fluid to the bellows means, and selectively exhausts pressurized fluid supplied to the bellows means from the bellows means.

5. The apparatus of claim 4, wherein:

the fluid control means includes a first manually operated valve that selectively controls draining pressurized fluid from the source of pressurized fluid and supplying the drained fluid to the bellows means, and a second manually operated valve that selectively controls exhausting pressurized fluid supplied to the bellows means from the bellows means.

6. The apparatus of claim 1, wherein:

a set of wheels support the transportable frame and enable the apparatus to be transported by being manually wheeled.

7. The apparatus of claim 1, wherein:

the expandable bellows means is an air bag having a bottom secured to the base platform and a top secured to the load platform, and the self-contained source of pressurized fluid is a tank of pressurized fluid supported on the frame and selectively communicated with the air bag.

8. The apparatus of claim 1, wherein:

a guide rail means is rigidly secured to the base platform at substantially a right angle relative thereto, and extends in a general upward direction from the base platform, and the load platform is attached to the guide rail means for upward and downward sliding movement relative to the guide rail means.

9. A transportable jack apparatus adapted to be transported to and positioned beneath an object to selectively raise and lower the object, the apparatus comprising:

a transportable frame;

a base platform connected to the frame, the base platform is pivotally connected to the frame and the frame is capable of being pivoted between a first and second position relative to the base platform, in the first position the frame is substantially perpendicular to the base platform and in the second position the frame is substantially parallel to the base platform;

a load platform positioned above the base platform;

a self-contained source of pressurized fluid supported on the frame; and an expandable bellows means secured between the base platform and the load platform, the bellows means being adapted to be selectively supplied with fluid from the fluid source, filling the bellows means and causing the bellows means to expand vertically and raise the load platform relative to the base platform and frame, and the bellows means being adapted to be selectively exhausted of fluid filling the bellows means, causing the bellows means to collapse vertically and lower the load platform relative to the base platform and frame.

10. The apparatus of claim 9, wherein:

the frame is releasably locked relative to the base platform in the first and second positions of the frame.

11. A transportable jack apparatus adapted to be transported and positioned beneath an object to selectively raise and lower the object, the apparatus comprising a base platform;

a guide rail means rigidly secured to the base platform at substantially a right angle relative thereto, and extending in a general upward direction from the base platform;

a load platform positioned above the base platform and attached to the guide rail means for upward and downward movement relative to the guide rail means;

an expandable bellows means secured between the base platform and the load platform, the bellows means being adapted to be selectively supplied with fluid filling the bellows means causing the bellows means to expand vertically and raise the load platform relative to the guide rail means and the base platform, and the expanded bellows means being adapted to be selectively exhausted of fluid filling the bellows means causing the bellows means to collapse vertically and lower the load platform relative to the guide rail means and the base platform;

the guide rail means includes at least a pair of vertical bars secured rigidly to the base platform at right angles relative to the base platform and extending in a generally vertically upward direction from the base platform; and a pair of brackets are connected to the load platform, each bracket of the pair engages around a vertical bar of the guide rail means for upward and downward vertical sliding movement of the pair of brackets and the load platform relative to the pair of vertical bars and the base platform, while preventing horizontal movement of the brackets relative to the vertical bars and base platforms.

12. The apparatus of claim 11, wherein:

a transportable frame is connected to the base platform and a self-contained source of pressurized fluid is supported on the frame, the bellows means being adapted to be selectively supplied with fluid from the fluid source, filling the bellows means and causing the bellows means to expand vertically.

13. The apparatus of claim 12, wherein:

the base platform is pivotally connected to the frame and the frame is capable of being pivoted between a first and second position relative to the base platform and guide rail means, in the first position the frame is substantially perpendicular to the base platform and in the second position the frame is substantially parallel to the base platform.

14. The apparatus of claim 12, wherein:

a set of wheels support the transportable frame and enable the apparatus to be transported by being manually wheeled.

15. The apparatus of claim 12, wherein:

a fluid control means communicates the source of pressurized fluid with the bellows means, the fluid control means selectively drains pressurized fluid from the source of pressurized fluid and supplies the drained pressurized fluid to the bellows means, and selectively exhausts pressurized fluid supplied to the bellows means from the bellows means.

* * * * *